United States Patent [19]

Bienek

[11] 4,087,925

[45] May 9, 1978

[54] HAND DRIER

[76] Inventor: Artur Bienek, Wilhelm-Leuschner-Strasse 35, 5500 Trier, Germany

[21] Appl. No.: 745,460

[22] Filed: Nov. 26, 1976

[30] Foreign Application Priority Data

Dec. 6, 1975 Germany ..... 7538941[U]

[51] Int. Cl.[2] ..... F26B 19/00

[52] U.S. Cl. ..... 34/60; 21/102 R; 21/DIG. 2; 34/202; 250/432 R; 250/437

[58] Field of Search ..... 34/86, 201, 202, 99, 34/82, 233, 243 R, 60; 21/102, DIG. 2, 101, 91, 92; 250/432, 437

[56] References Cited

U.S. PATENT DOCUMENTS

| | | | |
|---|---|---|---|
| 2,411,365 | 11/1946 | Card | 34/202 |
| 3,066,423 | 12/1962 | Solem | 34/86 |
| 3,603,002 | 9/1971 | Spierer | 34/202 |
| 3,667,134 | 6/1972 | Rockson | 34/202 |
| 3,766,397 | 10/1973 | Rockson | 34/202 |

*Primary Examiner*—Kenneth W. Sprague
*Assistant Examiner*—James C. Yeung
*Attorney, Agent, or Firm*—Robert W. Beach; Ward Brown

[57] ABSTRACT

A hand drier comprising a fan arranged in a housing having an air inlet and an air outlet, and a heating device for warming the air passing through the housing, is characterized by the provision in the housing of a micro glass fibre fleece through which the air is filtered. A sterilizer tube or lamp may also be provided in the housing for killing bacteria drawn into the housing by the air flow.

4 Claims, 2 Drawing Figures

HAND DRIER

This invention concerns a hand drier of the type comprising a fan arranged in a housing having an air inlet aperture and an air outlet aperture, and a heating device for producing warm air emerging at the air outlet aperture.

In the case of the known hand driers which are equipped with electrically-operated fans, cool fresh air is drawn in from the room in which the hand drier is situated, is warmed in the hand drier and is blown out in such a way that it can pass onto the user's washed but still damp hands in order to dry these. Through the drawing-in of the room air, naturally also all of the germs which are present in the air and which are really numerous, more especially in toilet rooms where such hand driers are often to be found, are drawn in and blown in concentrated manner onto the user's hands. The result of this is that, as recent tests have shown, the known hand driers are in no way hygienically satisfactory, but rather supply a great deal of bacteria.

An object of the present invention is to provide an improved hand drier of the type referred to.

With this object in view, the present invention provides a hand drier of the type referred to, characterised in that a micro glass fibre fleece is arranged in the housing between the air inlet aperture and the fan.

Preferably a sterilizer tube or lamp is arranged in a space of the drier housing which is separated from the fan by the micro glass fibre fleece, or in a space of the drier housing between the micro glass fibre fleece and the fan. The micro glass fibre fleece may be arranged in obliquely inclined manner in the drier housing, and may be mounted in the drier housing so as to be releasable for easy exchangeability.

Advantageously arranged beside the air outlet aperture is a light barrier switch for switching the fan ON and OFF.

Preferably there is provided at the air outlet aperture, an outwardly swingable closure flap which is biassed toward its closed position by virtue of a spring force or a weight and which opens when the air coming from the fan exceeds a pressure threshold.

A preferred embodiment of hand drier will be described further, by way of example, with reference to the accompanying drawings, in which.

Figure 1:
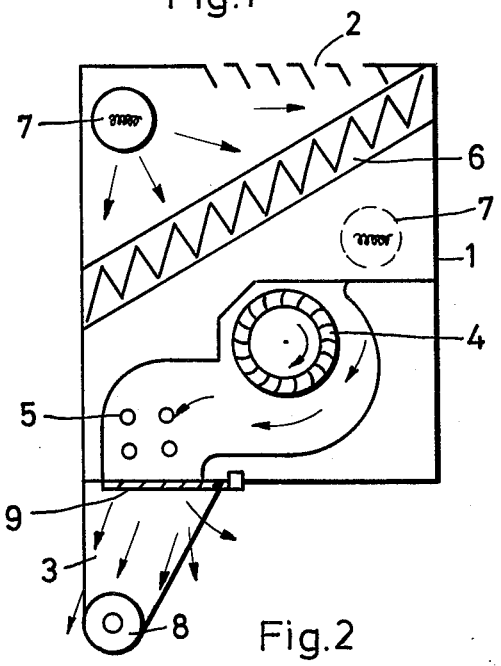
FIG. 1 shows the hand drier in perpendicular section.
Figure 2:
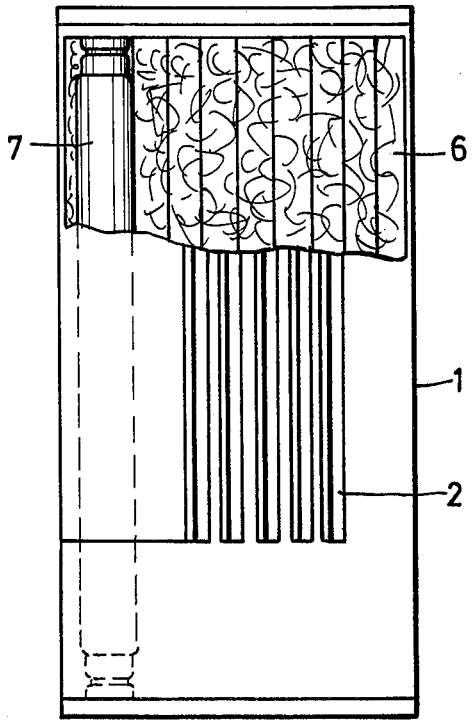
FIG. 2 shows the hand drier of FIG. 1 in horizontal section and partial plan view.

The hand drier shown in the drawings consists of a drier housing 1 having an air inlet aperture 2 at its upper side and an air outlet aperture 3 at its underside. Arranged in the drier housing are a fan 4 and a heating device 5 which consists of heating wires.

Located between the air inlet aperture 2 and the fan is a generally planar, obliquely inclined micro glass fibre fleece 6 through which the supply air has to pass before it reaches the fan 4. Seated in that part of the housing 1 which is separated from the fan chamber by the micro glass fibre fleece 6 is a sterilizer tube or lamp 7 such as an ultraviolet lamp that emits bactericidal ultraviolet radiation which kills off the germs, bacteria, bacillii or the like which have entered with the supply air into the interior of the housing 1. Tube 7 is located closely adjacent to fleece 6 and, as diagrammatically illustrated by the arrows in the upper left corner of FIG. 1, is directed to radiate sterilizing rays onto the inflow surface of the fleece facing the air inlet aperture 2.

As is indicated by broken lines in FIG. 1, another sterilizer tube 7 can be arranged in the space between the micro glass fibre fleece 6 and the fan 4.

The obliquely-inclined arrangement of the micro glass fibre fleece 6 serves to enlarge the air-flow passage area therethrough. The micro glass fibre fleece 6 is releasably mounted in the housing, in order to enable it to be exchanged for a new one after a period of use.

A light barrier switch 8 is provided near the warm air outlet 3, in a order to control the fan operation in known manner.

Seated at the air outlet aperture 3 is an outwardly-swingable flap 9 which is held on the drier housing 1 by way of a cord or the like. The flap is spring-loaded or weight-loaded, so that it keeps the air outlet aperture closed. Only when the pressure of air coming from the fan exceeds a value which overcomes the force of the spring or of the weight does the flap 9 swing downwards to open the air outlet.

The arrangement of the closure flap 9 ensures that, when the fan is switched off, the inner space of the housing is closed, so that any germs present therein are reliably killed off by the action of radiation from the sterilizer tube 7.

I claim:

1. In a hand drier including a housing having an air inlet and an air outlet, a fan in the housing operable to draw air into the housing through the air inlet and blow air out of the housing through the air outlet and a heating device for warming air in the housing, the improvement comprising a micro glass fibre fleece disposed in the housing between the air inlet and the fan, and a sterilizer lamp located closely adjacent to said fleece and directed to radiate sterilizing rays onto said fleece.

2. In the hand drier defined in claim 1, the sterilizer lamp being disposed between the air inlet and the micro glass fibre fleece and radiating sterilizing rays onto the inflow surface of the fleece.

3. In the hand drier defined in claim 1, the sterilizer lamp emitting sterilizing rays whether or not the fan is actuated to draw air through the air inlet and to blow air through the air outlet, for substantially continuously sterilizing air in the housing.

4. In the hand drier defined in claim 1, the micro glass fibre fleece being generally planar and disposed obliquely relative to the side of the housing having the air inlet.

* * * * *